United States Patent [19]

Jellinek et al.

[11] Patent Number: 4,831,101

[45] Date of Patent: May 16, 1989

[54] POLYGLYCIDYL ETHERS FROM PURIFIED EPIHALOHYDRIN

[75] Inventors: Karl Jellinek, Iserlohn; Bert Meier, Menden; Rolf Herzog, Bottrop; Günter Reinsch, Dinslaken, all of Fed. Rep. of Germany

[73] Assignee: Rutgerswerke AG, Fed. Rep. of Germany

[21] Appl. No.: 100,471

[22] Filed: Sep. 24, 1987

[30] Foreign Application Priority Data

Oct. 28, 1986 [DE] Fed. Rep. of Germany ..... 3636560

[51] Int. Cl.[4] ..... C08G 59/06; C08G 59/08

[52] U.S. Cl. ..... 528/87; 528/95; 549/514; 549/515; 549/517; 549/541; 525/507

[58] Field of Search ..... 549/514, 515, 517, 541; 525/507; 528/95

[56] References Cited

U.S. PATENT DOCUMENTS 4,447,598 5/1984 Caskey et al. ..... 528/489

4,485,221 11/1984 Krueger et al. ..... 525/507

*Primary Examiner*—Earl Nielsen

*Assistant Examiner*—Frederick Krass

*Attorney, Agent, or Firm*—Bierman and Muserlian

[57] ABSTRACT

A process for the preparation of at least one member of the group consisting of monoglycidyl and polyglycidyl compounds comprising reacting a member of the group consisting of mono- and polyvalent phenols, aromatic amines and aromatic carboxylic acids with an epihalohydrin substantially free of halogenated hydrocarbons.

3 Claims, No Drawings

POLYGLYCIDYL ETHERS FROM PURIFIED EPIHALOHYDRIN

STATE OF THE ART

It is known that in the reaction of glycidyl compounds, especially epihalohydrins, with nucleophilic reagents such as phenols, aromatic amines or aromatic carboxylic acids undesired halogenated hydrocarbon are sometimes spontaneously formed which are undesirable in the epoxy resins formed therefrom.

Various attempts have been made to produce highly purified epoxy resins with a low chlorine content so that the epoxy resins may be used for the manufacture of electronic components, for example. The presence of hydrolyzable chlorine compounds allows the formation of chloride ions under the influence of moisture and/or heat which leads to corrosion damage.

U.S. Pat. Nos. 4,485,221 and No. 4,447,598 describe methods of degradation of undesired chlorine-containing by-products in epoxy resins by treatment with strong alkaline solutions such as potassium tert.-butylate in tert.-butanol or with alkaline substances in suitable solvent mixtures such as methyl ethyl ketone and toluol. The disadvantage of these methods is that the intensive alkali treatment leads to undesirable side reactions such as anionic polymerization of the epoxide group to high-molecular insoluble by-products, addition reactions of epoxide groups with aliphatic OH groups and alkaline hydrolysis of the epoxide group to glycols. The results are epoxide resins of inferior quality (lowered ability to maintain form when exposed to heat, increased hydrophilic properties and greater viscosity) and the decreased yield leads to lower cost-efficiency.

In DP No. 1,618,275, an addition reaction in the presence of quaternary ammonium salts as catalyst of epichlorohydrin and nucleophilic reactants such as phenols is described wherein the dehydrohalogenation step is carried out with an alkali metal hydroxide solution saturated with ammonium carbonate under very mild conditions. Even though this reaction results in resins with a hydrolyzable chlorine content of only 500 to 1000 ppm, the method is not practicable, since due to the low reaction temperature of 65° C., the addition reaction is too slow.

In variations of this process described in DE-A No. 3,402,247 and EP-A No. 0,121,260, the conversion takes place with phase transfer catalysts in a heterogeneous reaction mixture under mild and thus selected reaction conditions. Suitable phase transfer catalysts are for example quaternary ammonium compounds like benzyltriethylammonium chloride but attempts at recreating such methods did not, however, yield the desired epoxide resins with extremely low hydrolyzable chlorine content.

DP No. 3,330,042 and DP No. 3,315,365 describe the preparation of low chlorine containing epoxide resins using linear and cyclic ethers, for example dioxane as an auxiliary solvent and quaternary ammonium salts during the conversion reaction of epichlorohydrin with nucleophilic compounds, for example o-cresol-novolaks. Aside from the fact that using ethers in chemical processes due to the formation of peroxides and the concommitant danger of explosion makes increased demands on the operating safety, this synthesis leads only to epoxide resins with a content of hydrolyzable chlorine on the order of magnitude of 100 to 500 ppm which, however, no longer fulfills the requirements.

OBJECTS OF THE INVENTION

It is an object of the inventio to prepare glycidyl compounds of superior quality and which have an hydrolyzable chlorine content which, when used in microelectronic structural components can still be tolerated, and particularly lies below 100 ppm This and other objects and advantages of the invention will become obvious from the following detailed description.

THE INVENTION

The novel process of the invention for the preparation of at least one member of the group consisting of monoglycidyl and polyglycidyl compounds comprises reacting a member of the group consisting of mono- and polyvalent phenols, aromatic amines and aromatic carboxylic acids with an epihalohydrin substantially free of halogenated hydrocarbons.

The epihalohydrins used in the synthesis of glycidyl compounds according to the state of the art, in particular epichlorohydrin qualities, have a very high degree of purity of 99 to 99.5%. The analysis of the epichlorohydrin impurities which are present in extremely low quantities have been determined to be, among others, approximately 10 to 25 low molecular weight, chlorine-containing hydrocarbons which, according to current knowledge, are considered to be entirely unreactive in epoxide resin synthesis. It has been found, surprisingly, that these low molecular weight chlorine-containing hydrocarbons are the source of the hydrolyzable chlorine in the glycidyl compounds.

It has further been found that mono- and/or polyglycidyl compounds having an hydrolyzable chlorine content of 10 to 60 ppm (determined in according with DIN 53,188) are obtained if, in a method known per se, mono- or polyvalent phenols, aromatic amines or carboxylic acids with epihalohydrins qualities are reacted which are essentially free of the mentioned low molecular halogen hydrocarbons. These epihalogenhydrin qualities have a purity of 99.7 to 99.99%, in particularly of 99.8 to 99.95%.

The resulting polyglycidyl compounds are used to form epoxide resins and the monoglycidyl compounds are useful as reaction thinner of these epoxide resins, preferably in the manufacture of electrical and electronic structure elements. In the cross-linked state, they form polymers which excellent mechanical and electrical properties and represent a permanent protection for the structural elements coated and insulated with them, even in extreme climatic conditions.

It is a further advantage of the invention that the conversion can be carried out without additional investments in convential equipment. For this reason, they represent a high degree of cost-effectiveness and product safety.

In the following example there are described several preferred embodiments to illustrate the invention. However, it should be understood that the invention is not intended to be limited to the specific embodiments.

Various modifications of the process of the invention may be made without departing from the spirit or scope thereof and it should be understood that the invention is intended to be limited only as defined in the appended claims.

EXAMPLES

EXAMPLE 1

Working example

In a 1 l reaction vessel fitted with an internal thermometer, dropping funnel, stirrer and separator 118 grs of novolak made from o-cresol (1 mole of phenolic OH-groups with an average functionality of 6) are solved in 740 grs of a highly pure epichlorohydrin (8 mols per mole of OH). The purity of the epichlorohydrin is estimated by gas chromatographic method and found to be 99.95 pure epichlorohydrin.

Within 5 hours 83.3 grs of a 48% aqueous sodium hydroxide solution are dropped constantly at 70° C. (temperature of the reaction medium) and at pressure of 210 mbar to the reaction medium.

During this reaction time, boiling epichlorohydrin and water are separated by the separator and the epichlorohydrin is fed back into the reaction medium continuously. Thereby the water is removed from the reaction medium. At the end of the reaction, the unreacted epichlorohydrin is distilled off and the resin is solved in toluene. The sodium chloride, formed during the reaction is filtrated off.

The filtrated solution of the resin is heated up to 105° C. Under stirring 5.4 grs of a 48% sodium hydroxide solution are added within 10 min and the temperature is held for further 20 min. Then 50 ml of hot water are added, the aqueous phase is separated, the organic phase is washed three times with hot water and then the toluene is disstilled off. The result is a glycidylether of an o-cresol novolak with a content of hydrolyzable Chlorine of 20 ppm.

EXAMPLE 2

Comparison example

The reaction is made as in example 1 with difference that an epichlorohydrin is used with a purity of 99.5% epichlorohydrin. The main side products are mono- and polychloropropene derivatives. The resulting epoxy resin has a content of hydrolyzable chlorine of 210 ppm.

What we claim is:

1. A process for the preparation of at least one member of the group consisting of monoglycidyl and polyglycidyl compounds with less than 100 ppm of hydrolyzable chlorine comprising reacting a member of the group consisting of mono- and polyvalent phenols, aromatic amines and aromatic carboxylic acids with an epihalohydrin with a purity of 99.7 to 99.99%.

2. The process of claim 1 wherein the epihalohydrin is epichlorohydrin.

3. The process of claim 2 wherein the purity of epichlorohydrin is 99.8 to 99.95%.

* * * * *